US007489310B2

(12) United States Patent
Kasai

(10) Patent No.: US 7,489,310 B2
(45) Date of Patent: Feb. 10, 2009

(54) SUPPLY OF A PROGRAMMING CURRENT TO A PIXEL

(75) Inventor: Toshiyuki Kasai, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 307 days.

(21) Appl. No.: 11/044,041

(22) Filed: Jan. 28, 2005

(65) Prior Publication Data

US 2005/0127845 A1 Jun. 16, 2005

Related U.S. Application Data

(62) Division of application No. 10/207,100, filed on Jul. 30, 2002, now Pat. No. 7,012,597.

(30) Foreign Application Priority Data

Aug. 2, 2001 (JP) ..... 2001-235394
Dec. 6, 2001 (JP) ..... 2001-372996

(51) Int. Cl.
*G09G 5/00* (2006.01)

(52) U.S. Cl. ..... 345/204; 345/76; 345/82; 345/211; 341/135; 341/136; 323/315; 323/317; 313/500; 315/169.1; 315/169.3

(58) Field of Classification Search ..... 345/76, 345/77, 80, 82, 690, 211–213, 92–94, 98–100; 341/135–137; 323/315, 317; 315/169.3, 315/291
See application file for complete search history.

(56) References Cited

U.S. PATENT DOCUMENTS 4,431,986 A 2/1984 Haque et al.
4,967,192 A 10/1990 Hirane et al.
5,138,310 A 8/1992 Hirane et al.
5,608,339 A 3/1997 Fujiwara
6,097,359 A 8/2000 Kwon et al.
6,353,402 B1 * 3/2002 Kanamori ..... 341/118
6,353,926 B1 3/2002 Parthesarathy et al.
6,501,466 B1 * 12/2002 Yamagishi et al. ..... 345/204
6,535,185 B2 * 3/2003 Kim et al. ..... 345/76
6,538,632 B1 * 3/2003 Yamazaki et al. ..... 345/98
6,549,184 B1 * 4/2003 Koyama et al. ..... 345/92
6,765,560 B1 7/2004 Ozawa
6,778,154 B2 * 8/2004 Van Velzen ..... 345/76

FOREIGN PATENT DOCUMENTS

EP 0 419 255 A2 3/1991

(Continued)

*Primary Examiner*—Henry N Tran
(74) *Attorney, Agent, or Firm*—Oliff & Berridge, PLC

(57) ABSTRACT

A data line drive circuit is equipped with a single line driver and a gate voltage generation circuit. The single line driver is constructed such that N groups (where N is an integer 2 or larger) of series connections of drive transistors and switching transistors are connected in parallel. The gate voltage generation circuit includes two transistors constituting a current mirror circuit, a drive transistor, and a constant voltage generation transistor. The range of an output current $I_{out}$ can be controlled by changing any of the design values of the parameters including: relative values $K_a$ and $K_b$ of the gain coefficient for the transistors, the source voltage VDREF of the gate voltage generation circuit, and the gate signal VRIN of the drive transistor.

15 Claims, 11 Drawing Sheets

FOREIGN PATENT DOCUMENTS

| | | | |
|---|---|---|---|
| EP | 1 039 440 | A1 | 9/2000 |
| EP | 1 130 781 | A2 | 9/2001 |
| JP | A-63-280568 | | 11/1988 |
| JP | A-03-118168 | | 5/1991 |
| JP | A-04-042619 | | 2/1992 |
| JP | A-06-314977 | | 11/1994 |
| JP | A-08-069577 | | 3/1996 |
| JP | A-09-022268 | | 1/1997 |
| JP | A-09-319323 | | 12/1997 |
| JP | A-2000-105574 | | 4/2000 |
| JP | A-2000-122608 | | 4/2000 |
| JP | A 2001-136068 | | 5/2001 |
| KR | 2000-0072736 | A | 5/1999 |
| KR | 10-0250411 | B | 1/2000 |

* cited by examiner

<Example of Iout change due to parameter adjustment>

| | Example 1 | Example 2 | Example 3 | Example 4 | Example 5 |
|---|---|---|---|---|---|
| Level | Standard | VRIN large | VDREF large | Ka large | Kb large |
| 1 | 520 | 1040 | 780 | 364 | 920 |
| 15 | 800 | 1600 | 1200 | 560 | 1200 |
| 31 | 1120 | 2240 | 1680 | 784 | 1520 |
| 63 | 1760 | 3520 | 2640 | 1232 | 2160 |
| 127 | 3040 | 6080 | 4560 | 2128 | 3440 |
| 255 | 5600 | 11200 | 8400 | 3920 | 6000 |
| Graph | G1 | G2 | G3 | G4 | G5 |

(Ioffset =500)

SUPPLY OF A PROGRAMMING CURRENT TO A PIXEL

PRIORITY

This is a Division of application Ser. No. 10/207,100 filed Jul. 30, 2002 now U.S. Pat. No. 7,012,597. The disclosure of the prior application is incorporated by reference herein in its entirety.

BACKGROUND

This invention relates to technology for generating a programming current supplied for setting the light emission level of a pixel circuit in a luminescent device.

In recent years, electro-optical devices have been developed using organic electroluminescent devices. A backlight is unneeded for organic electroluminescent devices as they are self-luminescent, so it is expected that they will be used to achieve display devices with low power consumption, a wide viewing angle and a high contrast ratio. In the present specification, an "electro-optical device" refers to a device for converting electrical signals to light. The most common form of an electro-optical device is a display device for converting electrical signals representing images to light representing images.

In an active matrix driven electro-optical device using organic electroluminescent devices, a pixel circuit is provided to adjust the light emission level or luminescent scale of each organic electroluminescent device. The light emission level in each pixel circuit is set by supplying a voltage or current value to the pixel circuit corresponding to the light emission level. The method of setting a light emission level using voltage is called a voltage programming method, and that for setting a light emission level using a current value is called a current programming method. Herein, the term "programming" is used to mean "setting the light emission level". In the current programming method, the current used when programming a pixel circuit is current programming method, the current used when programming a pixel circuit is called the "programming current". In a current programming type electro-optical device, a current generation circuit is used to generate a programming current having an accurate current value corresponding to the light emission level and supplying it to each pixel.

A programming current value corresponding to the light emission level, however, depends on the structure of the pixel circuit. The structure of pixel circuits often differs somewhat according to the design of the electro-optical device. Thus, there has been desired a current generation circuit whose range of output current values (programming current values) is easy to set according to the actual structure of the pixel circuit.

SUMMARY OF THE INVENTION

Accordingly, a first object of the present invention is to provide a technology with which the range of the programming current values can be set easily. A second object is to provide a current generation circuit with superior durability and productivity whose circuit structure is simple, and a driving method therefor, as well as electro-optical devices, semiconductor integrated circuit devices, and electronic devices using that current generation circuit.

In order to attain at least part of the above and other related objects of the present invention, there is provided an electro-optical device comprising: a pixel matrix in which pixels each including a luminescent element are arrayed in the form a matrix; a plurality of scan lines each connected to a pixel group arrayed in a row direction of the pixel matrix; a plurality of data lines each connected to a pixel group arrayed in a column direction of the pixel matrix; a scan line drive circuit, connected to the plurality of scan lines, for selecting one row in the pixel matrix; and a data line drive circuit for generating a data signal having a current value corresponding to a level of light to be emitted by the luminescent element, and outputting the data signal to at least one of the plurality of data lines. The data line drive circuit comprises: a current-addition type current generation circuit having a structure where N series connections of a first drive transistor for generating a prescribed current and a first switching transistor whose on/off switching is controlled in response to a control signal supplied by an external circuit are connected mutually in parallel, where N is an integer of 2 or greater; and a control-electrode signal generation circuit for generating a control-electrode signal having a prescribed signal level and supplying the control-electrode signal commonly to control electrodes of N number of first drive transistors.

The present invention is also directed to a current generation circuit comprising: constant current generation means; a signal input line; an output terminal; and current output means for outputting to the output terminal an output current generated based on a reference current supplied from the constant current generation means and on a signal supplied to the signal input line.

These and other objects, features, aspects, and advantages of the present invention will become more apparent from the following detailed description of the preferred embodiments with the accompanying drawings.

DESCRIPTION OF THE PREFERRED EMBODIMENT

Embodiments of the present invention will be described below in the following sequence:

A. The overall structure of the device;
B. First embodiment;
C. Second embodiment;
D. Embodiments applied to electronic devices; and
E. Modified embodiments

A. The Overall Structure of the Device

Figure 1:
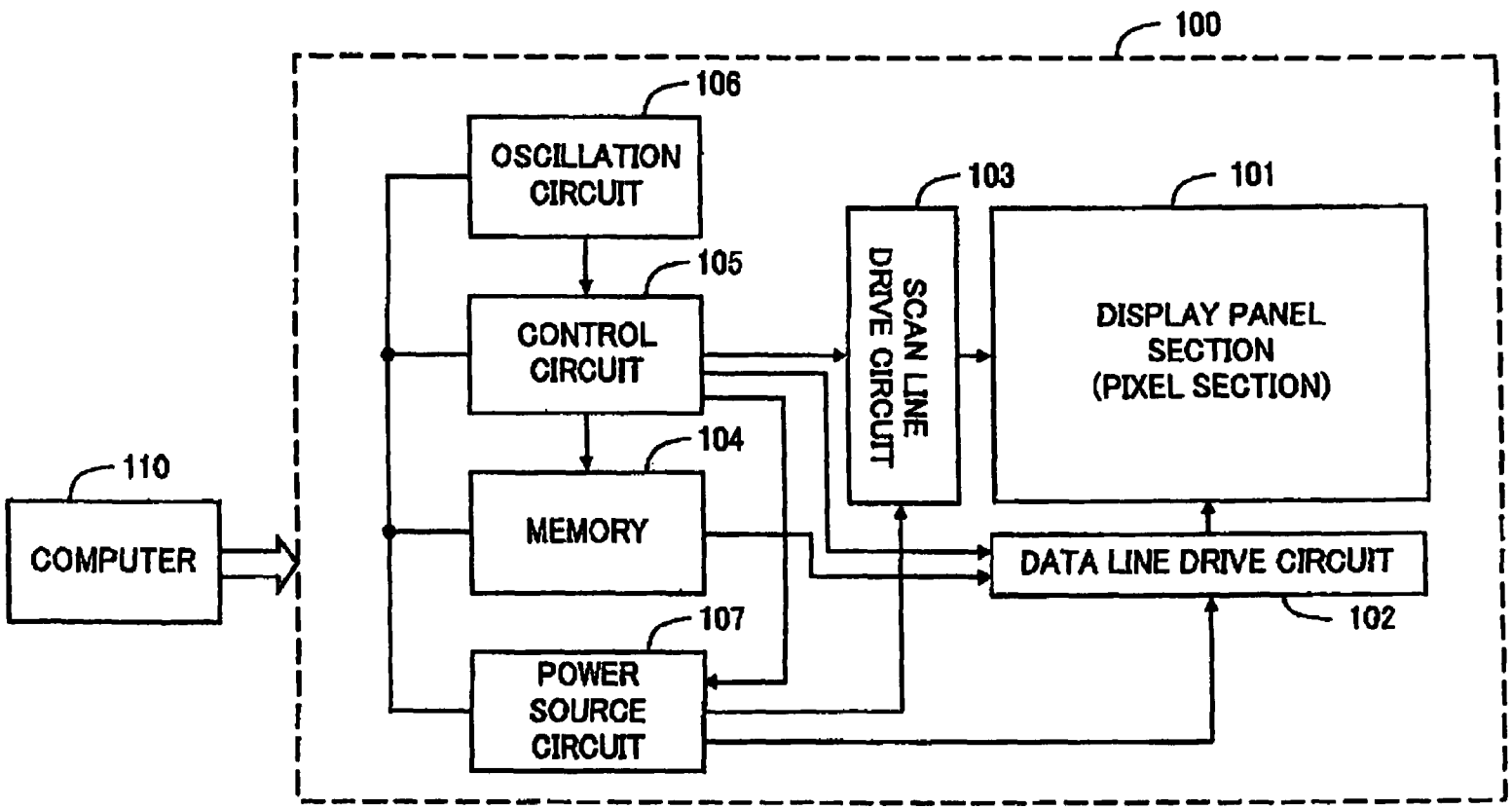
FIG. 1 is a block diagram showing the circuit structure of the photoelectric device 100 as one embodiment of the present invention.

FIG. 1 is a block diagram showing a circuit structure of an electro-optical device 100 as one embodiment of the present invention. The electro-optical device 100 is equipped with a display panel section 101 (referred to as a "pixel section") where the luminescent elements are disposed in the form of a matrix, a data line drive circuit 102 for driving the data lines in the display panel section 101, a scan line drive circuit 103 (also referred to as a "gate driver") for driving the scan lines (also referred to as "gate lines") in the display panel section 101, a memory 104 for storing display data provided by the computer 110, an oscillation circuit 106 for providing reference operation signals to other constituent elements, a power source circuit 107, and a control circuit 105 for controlling each constituent element in the electro-optical device 100.

The constituent elements 101 to 107 in the electro-optical device 100 may be constructed of independent parts thereof (for example, a semiconductor integrated circuit device of one chip), or a part or the entirety of the constituent elements 101 to 107 may be constructed as one piece. For example, the data line drive circuit 102 and the scan line drive circuit 103 may be constructed as one piece on the display panel section 101. Also, part of or the entirety of the constituent elements 102 to 106 may be constructed with a programmable IC chip whose function is implemented as software by a program written to the IC chip.

Figure 2:
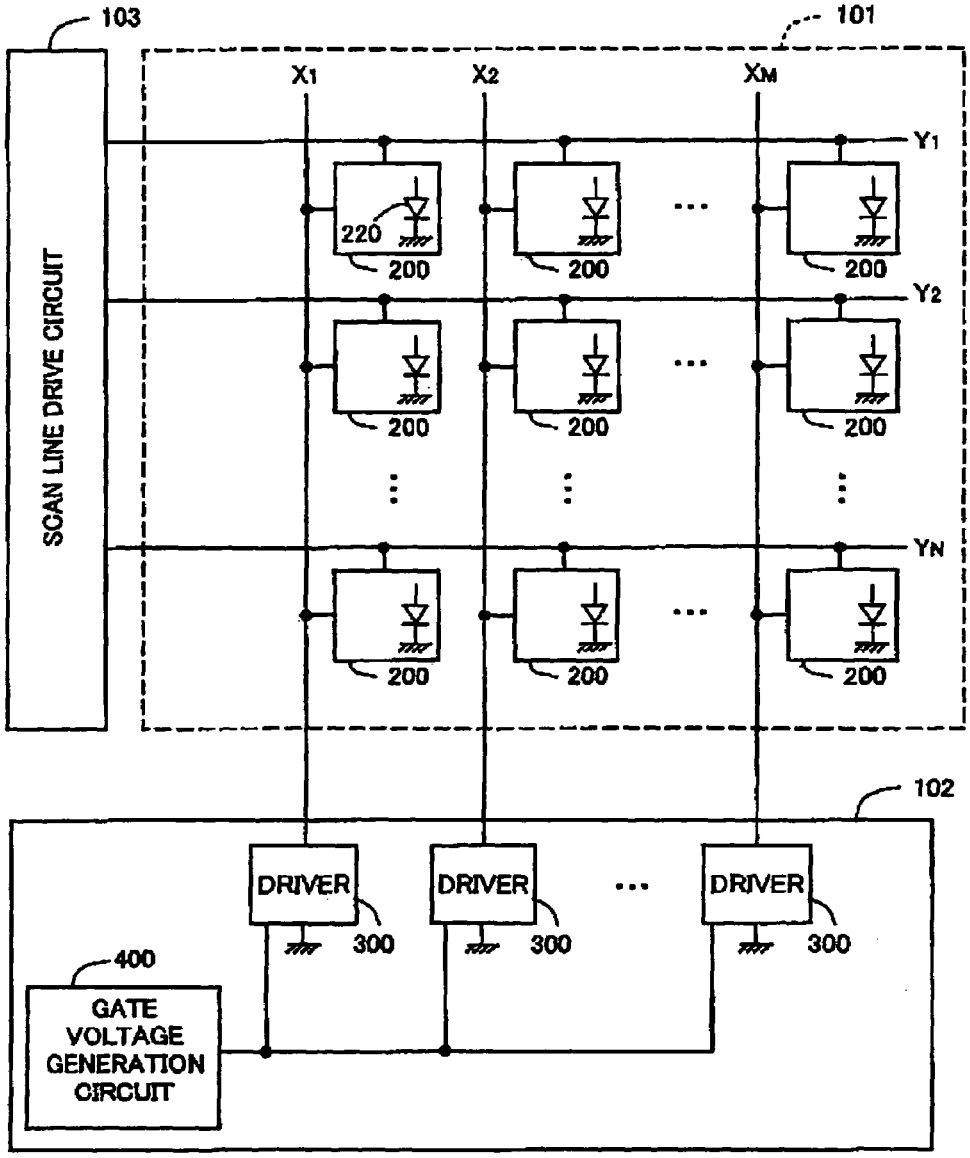
FIG. 2 is a block diagram showing the internal structure of the display panel section 101 and the data line drive circuit 102.

FIG. 2 shows the internal structure of the display panel section 101 and the data line drive circuit 102. The display panel section 101 is provided with a plurality of pixel circuits 200 arrayed in the form of a matrix, and each pixel circuit 200 includes an organic electroluminescent device 220. A plurality of data lines $X_m$ (where m is from 1 to M) extending in the horizontal direction and a plurality of scan lines $Y_n$ (where n is from 1 to N) extending in the vertical direction are each connected to the matrix of the pixel circuits 200. The data lines are also referred to as "source lines" and the scan lines are also referred to as "gate lines". In the present specification, the pixel circuits 200 are also referred to as "unit circuits" and "pixels". The transistors in the pixel circuits 200 are ordinarily constructed with a TFT.

The scan line drive circuit 103 selectively drives one of the plurality of scan lines $Y_n$, thereby selecting a group of pixel circuits in one row. The data line drive circuit 102 is provided with a plurality of single line drivers 300 for driving the data lines $X_m$ respectively as well as with a gate voltage generation circuit 400. The gate voltage generation circuit 400 supplies the single line drivers 300 with a gate control signal having a prescribed voltage value. The internal structures of the gate voltage generation circuit 400 and the single line drivers 300 will be described later.

The single line drivers 300 provide data signals to the pixel circuits 200 through the data lines $X_m$. When the internal states (described below) of the pixel circuits 200 are set according to the data signals, the value of the current flowing at the organic electroluminescent devices 220 is accordingly controlled, resulting in the control of the luminescent stage of the organic electroluminescent device 220.

A control circuit 105 (FIG. 1) converts display data (pixel data) for representing the display state of the display panel section 101 to matrix data for representing the light emission level of each organic electroluminescent device 220. The matrix data contains scan line drive signals for successively selecting a group of pixel circuits in one row and data line drive signals for indicating the level of the data line signal provided to the organic electroluminescent devices 220 in the selected group of pixel circuits. The scan line drive signal and data line drive signal are supplied to the scan line drive circuit 103 and the data line drive circuit 102, respectively. The control circuit 105 also controls the timing used for driving the scan lines and data lines.

Figure 3:
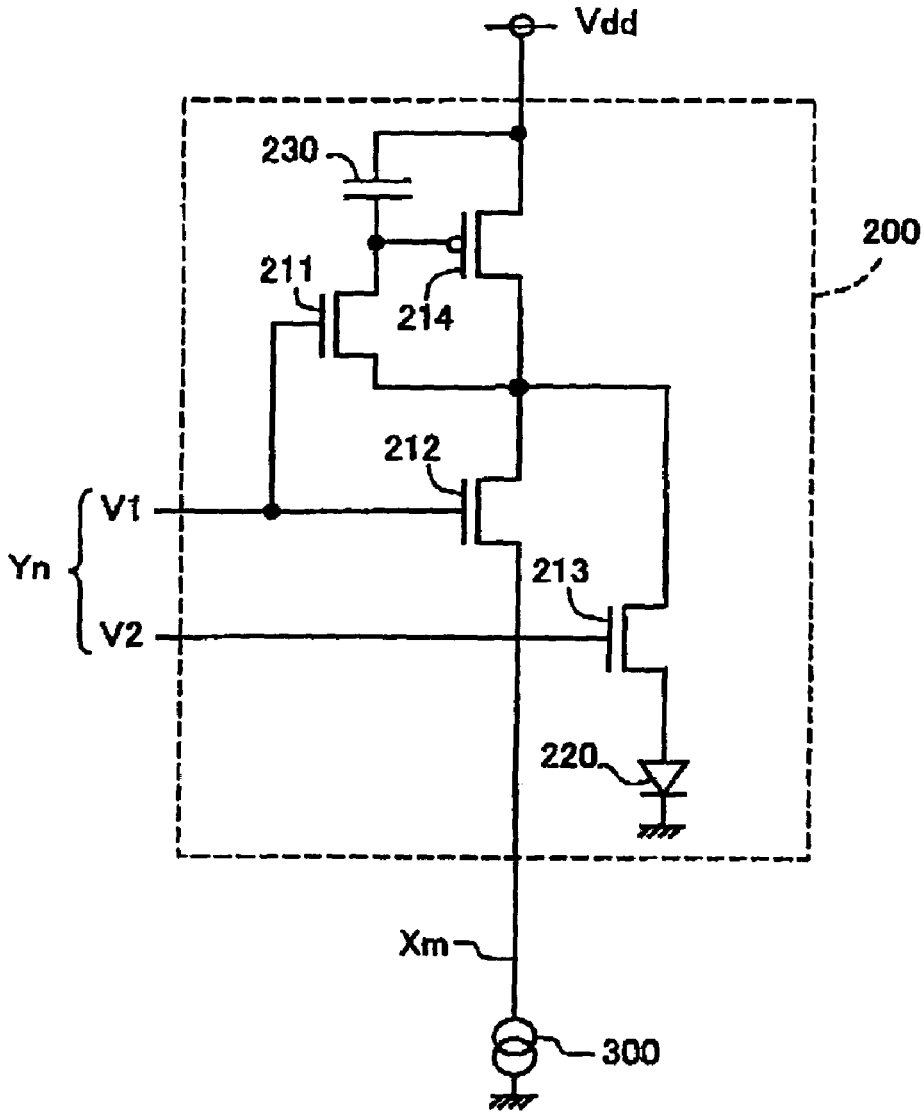
FIG. 3 is a schematic diagram showing the internal structure of the pixel circuit 200.

FIG. 3 is a schematic diagram showing the internal structure of the pixel circuit 200. The pixel circuits 200 are disposed at the intersection of the m-th data line $X_m$ and the n-th scan line $Y_n$. The scan lines $Y_n$ contain two sub-scan lines V1 and V2.

The pixel circuit 200 is a current programming circuit for regulating the light emission level of the organic electroluminescent device 220 in response to the value of the current flowing in the data line $X_m$. In greater detail, the pixel circuit 200 has four transistors 211 to 214 and a storage capacitor 230 (referred to also as a "storage condenser" and a "memory capacitor") in addition to an organic electroluminescent device 220. The storage capacitor 230 holds an electrical charge in response to the data signal supplied through the data line $X_m$, and thereby regulates the light emission level of the organic electroluminescent device 220. In other words, the storage capacitor 230 holds a voltage in response to the current flowing in the data line $X_m$. The first to third transistors 211 to 213 are n-channel FETs; the fourth transistor 214 is a p-channel FET. The organic electroluminescent device 220 is a current injection (current driven) type luminescent element similar to a photodiode, and is represented here with a diode symbol.

The source of the first transistor 211 is connected to the drain of the second transistor 212, the drain of the third transistor 213 and the drain of the fourth transistor 214. The drain of the first transistor 211 is connected to the gate of the fourth transistor 214. The storage capacitor 230 is connected between the gate and the source of the fourth transistor 214. Also, the source of the fourth transistor 214 is connected to a power supply voltage Vdd.

The source of the second transistor 212 is connected to a single line driver 300 (FIG. 2) through a data line $X_m$. The organic electroluminescent device 220 is connected between the source of the third transistor 213 and the ground voltage.

The gates of the first and second transistors 211 and 212 are commonly connected to the first sub-scan line V1. Also, the gate of the third transistor 213 is connected to the second sub-scan line V2.

The first and second transistors 211 and 212 are switching transistors used when accumulating a charge in the storage capacitor 230. The third transistor 213 is a switching transistor held in an ON state during the luminescent interval of the organic electroluminescent device 220. The fourth transistor 214 is a drive transistor for controlling the value of the current flowing in the organic electroluminescent device 220. The value of the current in the fourth transistor 214 is controlled by the amount of charge (amount of accumulated charge) held in the storage capacitor 230.

Figures 4A, 4B, 4C, 4D:
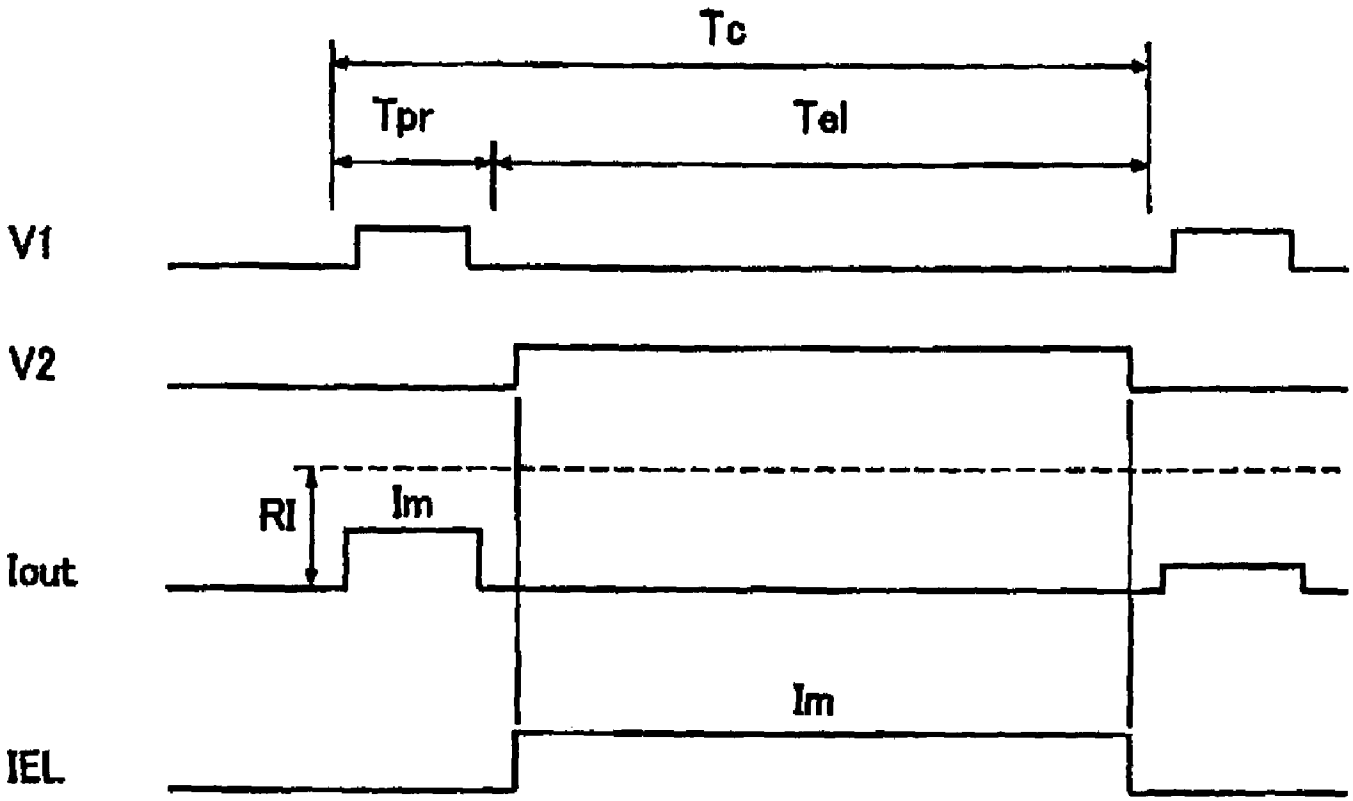
FIGS. 4(*a*)-4(*d*) are timing charts showing the operation of the pixel circuit 200.

FIGS. 4(*a*)-4(*d*) are timing charts indicating the operation of the pixel circuit 200. In the figure, the value of the voltage in the first sub-scan line V1 (hereinafter, referred to as the "first gate signal V1"), the value of the voltage in the second sub-scan line V2 (hereinafter, referred to as the "second gate signal V2"), the value of the current $I_{out}$ in the data line $X_m$ (hereinafter, referred to as the "data signal $I_{out}$"), and the value of the current IEL flowing in the organic electroluminescent device 220 are shown.

The driving period Tc is separated into a programming period $T_{pr}$ and a light emission period $T_{el}$. The "driving period Tc" means the period during which the light emission levels of all the organic electroluminescent devices 220 in the display panel section 101 are updated one at a time and is equivalent to a so-called frame cycle. Updating of the light emission levels is carried out by groups of pixel circuits in a row wherein the light emission levels of N column pixel circuit group are successively updated during a driving period Tc. For example, when light emission levels of all the pixel circuits are being updated at 30 Hz, the driving period Tc is approximately 33 ms.

During the programming period $T_{pr}$, the light emission level of the organic electroluminescent devices 220 is set in the pixel circuit 200. In the present specification, the setting of light emission level to a pixel circuit 200 is referred to as "programming". For example, when the driving period Tc is approximately 33 ms, and the total number N of the scan lines $Y_n$ is 480, the programming period $T_{pr}$ is approximately 69 μs (33 ms/480) or less.

In the programming period $T_{pr}$, first, the second gate signal V2 is set to the L level, and the third transistor 213 is kept in an OFF state. Next, the first gate signal V1 is set to the H level and the first and second transistors 211 and 212 are switched to an ON state while the value of the current $I_m$ flows on the data line $X_m$ corresponding to the light emission level. At this time, the single line drive 300 (FIG. 2) of the data line $X_m$ functions as a constant current source in which the value of the current $I_m$ flows constant corresponding to the light emission level. As indicated in FIG. 4(*c*), the value of the current $I_m$ is set according to the light emission level of the organic electroluminescent device 220 within a prescribed current range RI.

An electric charge corresponding to the value of the current $I_m$ flowing through the fourth transistor 214 (drive transistor) is held in the storage capacitor 230. The voltage stored in the storage capacitor 230 is therefore applied between the source and gate of the fourth transistor 214. In the present specification, the value of the current $I_m$ of the data signal used in programming is referred to as the "programming current $I_m$".

When the programming is complete, the scan line drive circuit 103 sets the first gate signal V1 to the L level to turn the first and second transistors 211 and 212 to an OFF state. The data line drive circuit 102 stops the data signal $I_{out}$.

During the light emission period $T_{el}$, the second gate signal V2 is set to the H level and the third transistor 213 is switched to an ON state while the first gate signal V1 is maintained at the L level with the first and second transistors 211 and 212 held in an OFF state. A voltage corresponding to the programming current $I_m$ is stored in the storage capacitor 230 beforehand, so a current that is about the same as the programming current $I_m$ flows in the fourth transistor 214. Thus, a current nearly equal to the programming current $I_m$ also flows in the organic electroluminescent device 220 which emits light at a level corresponding to the value of the current $I_m$. The type of pixel circuit 200 where the voltage in the storage capacitor 230 is written in this manner by the value of the current $I_m$ is referred to as a "current programmable circuit".

B. First Embodiment

Figure 5:
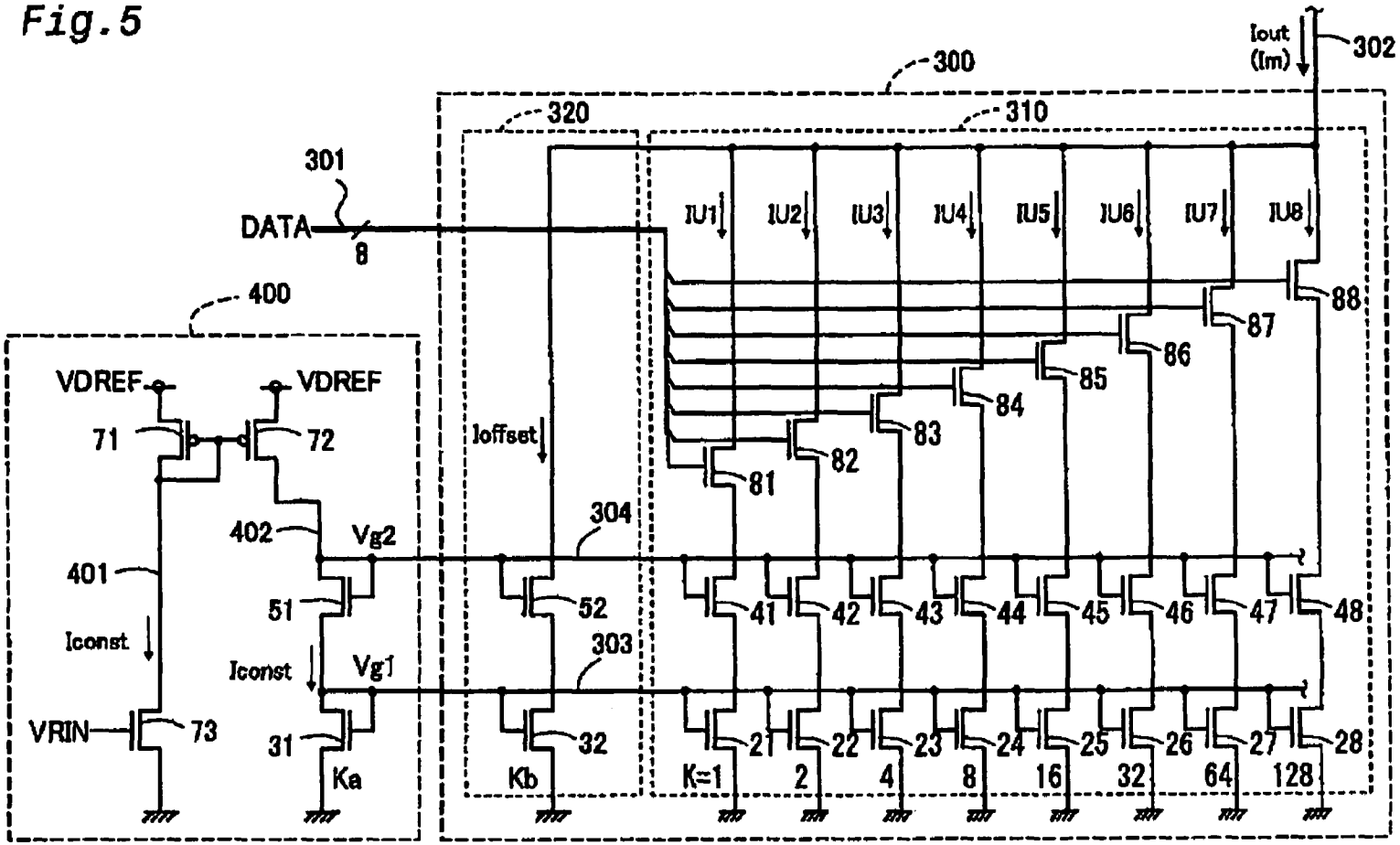
FIG. 5 is a schematic diagram showing the internal structure of the single line driver 300 and the gate voltage generation circuit 400.

FIG. 5 is a schematic diagram showing the internal structure of the single line driver 300 and the gate voltage generation circuit 400. The single line driver 300 is provided with an 8-bit D/A converter section 310 and an offset current generation circuit 320.

The D/A converter section 310 has eight current lines IU1 to IU8 connected in parallel. The first current line IU1 has a switching transistor 81, a resistance transistor 41 functioning as a type of resistor element, and a drive transistor 21 functioning as a constant current source in which a prescribed current flows, all connected in series between a data line 302 and a ground potential. The other current lines IU2 to IU8 have similar structures. The three types of transistors 81 to 88, 41 to 48 and 21 to 28 are all n-channel FETs in the example in FIG. 5. The gates of the eight drive transistors 21 to 28 are connected commonly to a first common gate line 303. Also, the gates of the eight resistance transistors 41 to 48 are connected commonly to a second common gate line 304. Each bit of the 8-bit data DATA provided by the control circuit 105 (FIG. 1) through a signal input line 301 is inputted to the gates of the eight switching transistors 81 to 88 respectively.

The ratio K of the gain coefficient β for the eight drive transistors 21 to 28 is set to 1:2:4:8:16:32:64:128. In other words, the relative value K of the gain coefficient β for the nth (where n is 1 to N) drive transistor is set to $2^{n-1}$. The gain coefficient β is defined as $\beta=K\beta_o=(\mu C_o W/L)$ as is well known. K represents the relative value, $\beta_o$ a prescribed constant, μ the carrier mobility, $C_o$ the gate capacity, W the channel width, and L the channel length. The drive transistor number N is an integer of 2 or greater. The drive transistor number N is unrelated to the scan line $Y_n$ number.

The eight drive transistors 21 to 28 function as constant current sources. The current drive capability of the transistors is proportional to the gain coefficient β, so the ratio of the current drive capability of the eight drive transistors 21 to 28 is 1:2:4:8:16:32:64:128. In other words, the relative value K of the gain coefficient for the drive transistors 21 to 28 is set to a value corresponding to the weight of each bit of the multi-level data DATA.

The current drive capability of the resistance transistors 41 to 48 is ordinarily set to a value at or above the current drive capability of the corresponding drive transistors 21 to 28. Thus, the current drive capability of the current lines IU1 to IU8 is determined by the drive transistors 21 to 28. The resistance transistors 41 to 48 acts as a noise filter for eliminating noise from the current value.

The offset current generation circuit 320 has a structure where a resistance transistor 52 and a drive transistor 32 are connected in series between the data line 302 and the ground potential. The gate of the drive transistor 32 is connected to the first common gate line 303, and the gate of the resistance transistor 52 is connected to the second common gate line 304. The relative value of the gain coefficient β for the drive transistor 32 is $K_b$. The offset current generation circuit 320 is not provided with a switching transistor between the drive transistor 32 and the data line 302, and in this way differs from the current lines in the D/A converter section 310.

The current line $I_{offset}$ of the offset current generation circuit 320 is connected in parallel to the eight current lines IU1 to IU8 of the D/A converter section 310. Thus, the total current flowing in the nine current lines $I_{offset}$ and IU1 to IU8 is outputted to the data line 302 as a programming current. More specifically, the single line driver 310 is a current-adding type current generation circuit. The reference symbols $I_{offset}$ and IU1 to IU8 are hereinafter used to represent both the current lines and the currents flowing therein.

The gate voltage generation circuit 400 contains a current mirror circuit section comprising two transistors 71 and 72. The gates of the two transistors 71 and 72 are connected to each other as well as to the drain of the first transistor 71. One terminal (the source) of each of the transistors 71 and 72 is connected to a power supply voltage VDREF for the gate voltage generation circuit 400. A drive transistor 73 is connected in series on a first wire 401 between the other terminal (the drain) of the first transistor 71 and the ground potential. A control signal VRIN having a prescribed voltage level is inputted from the control circuit 105 to the gate of the drive transistor 73. A resistance transistor 51 and a constant voltage generation transistor 31 (also referred to as a "control electrode signal generation transistor") are connected in series on a second wire 402 between the other terminal (the drain) of the second transistor 72 and the ground potential. The relative value of the gain coefficient β for the constant voltage generation transistor 31 is $K_a$.

The gate and the drain of the constant voltage generation transistor 31 are connected to each other as well as to the first common gate line 303 of the single line driver 300. Also, the gate and drain of the resistance transistor 51 are connected to each other as well as to the second common gate line 304 of the single line driver 300.

In the example in FIG. 5, the two transistors 71 and 72 constituting the current mirror circuit are composed of p-channel FETs, and the other transistors are composed of n-channel FETs.

When a control signal VRIN with a prescribed voltage level is inputted to the gate of the drive transistor 73 of the gate voltage generation circuit 400, a constant reference current $I_{const}$ is generated in response to the voltage level of the control signal VRIN on the first wire 401. The two transistors 71 and 72 constitute a current mirror circuit, so the same reference current $I_{const}$ flows on the second wire 402 as well. There is no need, however, for the currents flowing on the two wires 401 and 402 to be identical, and in general, the first and second transistors 71 and 72 may be constructed so that the current on the second wire 402 is proportional to the reference current $I_{const}$ on the first wire 401.

The current $I_{const}$ causes prescribed gate voltages $V_{g1}$ and $V_{g2}$ between the gate and drain of the two transistors 31 and 51 respectively on the second wire 402. The first gate voltage $V_{g1}$ is applied commonly to the gates of the nine drive transistors 32, 21-28 in the single line driver 300 through the first common gate line 303. Also, the second gate voltage $V_{g2}$ is applied commonly to the gates of the nine resistance transistors 52, 41-48 through the second common gate line 304.

The current drive capabilities of the current lines $I_{offset}$, IU1-IU8 are determined by the gain coefficients β of the respective drive transistors 32, 21-28 and the applied gate voltage. Thus, a current flowing whose value is proportional to the relative value K of the gain coefficient β of each drive transistor can be obtained in response to the gate voltage $V_{g1}$ at each respective current line $I_{offset}$, IU1-IU8 of the single line driver 300. When an 8-bit data DATA is provided by the control circuit 105 through the signal input line 301, the on/off switching of the eight switching transistors 81 to 88 is controlled in response to the value of each bit of the multi-bit data DATA. As a result, a programming current $I_m$ having a current value corresponding to the value of the multi-bit data DATA is outputted to the data line 302.

It should be noted that the single line driver 300 includes the offset current generation circuit 320, so the value of the multi-bit data DATA and the programming current $I_m$ have an offset and their graphical relationship is not a proportional one passing through the origin. Providing this offset has the advantage that the degree of freedom in setting the range of the programming current values is increased, so the programming current values can be easily set to have a favorable range.

Figures 6A, 6B:
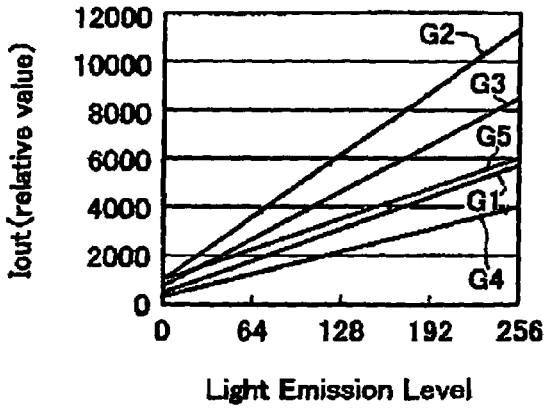
FIGS. 6(*a*) and 6(*b*) are explanatory diagrams showing an example of the relationships between the output current $I_{out}$ from the data line drive circuit 102 and light emission level values.

FIGS. 6(*a*) and 6(*b*) show Examples 1 to 5 with the relationship of the output current $I_{out}$ of the data line drive circuit 102 with the level of the multi-bit data DATA. The table of FIG. 6(*a*) shows the reference Example 1 as well as Examples 2 to 5 in which the below four parameters have been changed respectively.

(1) VRIN: The voltage value of the gate signal for the drive transistor 73 in the gate voltage generation circuit 400.

(2) VDREF: The source voltage of the current mirror circuit in the gate voltage generation circuit 400.

(3) $K_a$: The relative value of the gain coefficient β for the constant voltage generation transistor 31 in the gate voltage generation circuit 400.

(4) $K_b$: The relative value of the gain coefficient β of the drive transistor 32 in the offset current generation circuit 320.

FIG. 6(*b*) shows the relationships in FIG. 6(*a*) in a graph. In Example 1, which is used as the "reference," each parameter is set to a prescribed reference value. In Example 2, only the voltage VRIN of the drive transistor 73 was set to a higher value than that of the reference Example 1. In Example 3, only the source voltage VDREF of the current mirror circuit is set to a higher value than that of the standard Example 2. In Example 4, only the relative value $K_a$ of the gain coefficient β for the constant voltage generation transistor 31 is set to a higher value than that of the reference Example 1. In Example 5, only the relative value $K_b$ of the gain coefficient β for the drive transistor 32 is set to a higher value than that of the reference Example 1.

As shown in the table and the graph, the value of the output current $I_{out}$ varies according to each of the VRIN, VDREF, $K_a$ and $K_b$ parameters. Thus, the range of the current values used for controlling the light emission level can be changed by changing at least one of these parameters. The values of the VRIN, VDREF, $K_a$ and $K_b$ parameters are set by adjusting the design values of the circuit parts related respectively thereto. In the circuit structure shown in FIG. 5, all of the four parameters VRIN, VDREF, $K_a$ and $K_b$ affect the range of the output current $I_{out}$, so the degree of freedom when setting the range of the output current $I_{out}$ is high, giving the advantage that it can be easily set to an arbitrary range.

It should be noted here that the output current $I_{out}$ is proportional to the reference current $I_{const}$ in the gate voltage generation circuit 400. Thus, the reference current $I_{const}$ is determined in response to the range of the current values required by the output current $I_{out}$ (in other words, the programming current $I_m$). At that time, there is the possibility that if the reference current $I_{const}$ value is set close to one of the ends of the range of the current values required as output current $I_{out}$, a small variance or error in the reference current $I_{const}$ may cause a large variance or error in the output current $I_{out}$ due to the performance of the circuit parts. Thus, in order to decrease the error in the output current $I_{out}$, it is favorable to set the value of the reference current $I_{const}$ close to the midpoint between the minimum and maximum values of the current value range of the output current $I_{out}$. Here, "close to the midpoint between the minimum and maximum values" is meant to be a range of about −10% to about +10% of the average or center value of the minimum and maximum values.

Figure 7:
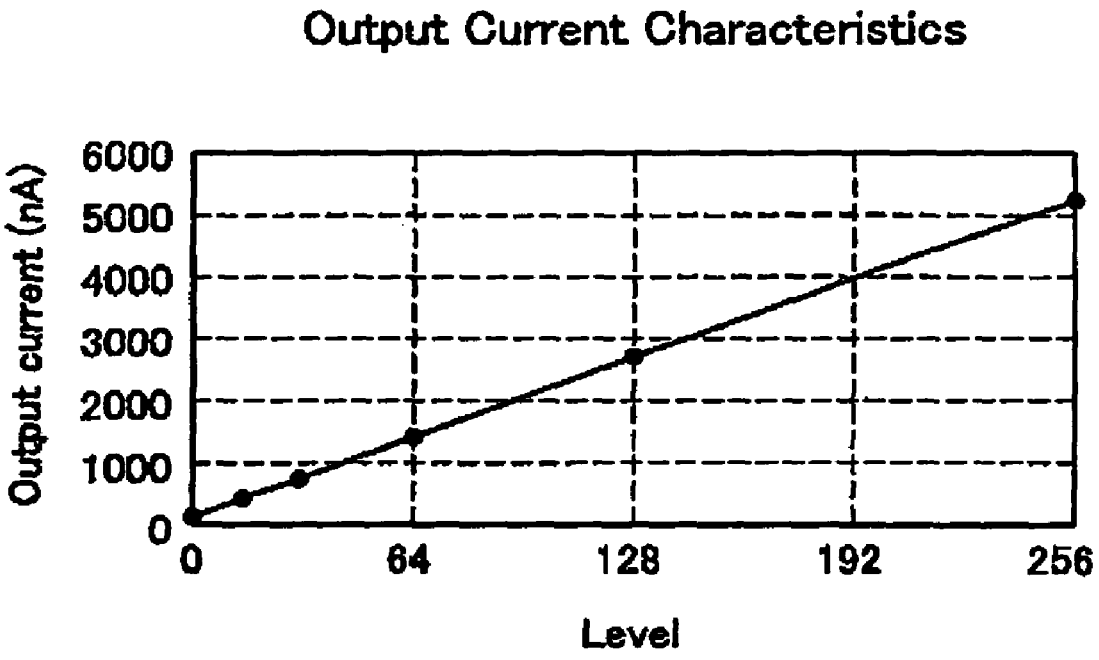
FIG. 7 is a graph showing one example of the relationship between the output current $I_{out}$ and the light emission level.

FIG. 7 is a graph showing an example relationship between the output current $I_{out}$ and the light emission level. In this example, the 256 levels from 0 to 255 is expressed by an output current $I_{out}$ with a range from 0 to 5000 nA. In this case, t is favorable to set the value of the reference current $I_{const}$ to around 2500 nA, which is the midpoint therefor.

The relative value $K_a$ of the gain coefficient β for the constant voltage generation transistor 31 may be set to a value equivalent to the central value (128) of the light emission level range in order to set the value of the reference current $I_{const}$ to the equivalent value of the output current $I_{out}$ corresponding to the central value (128) of the light emission level range in the circuit in FIG. 5.

As explained above, the data line drive circuit 102 in the first embodiment has the advantage that the design value of one or more parameters may be arbitrarily changed to arbitrarily regulate the range of the output current $I_{out}$ and the programming current $I_m$. There is another advantage that the circuit 102 has excellent durability and productivity because its structure is extremely simple.

C. Second Embodiment

Figure 8:
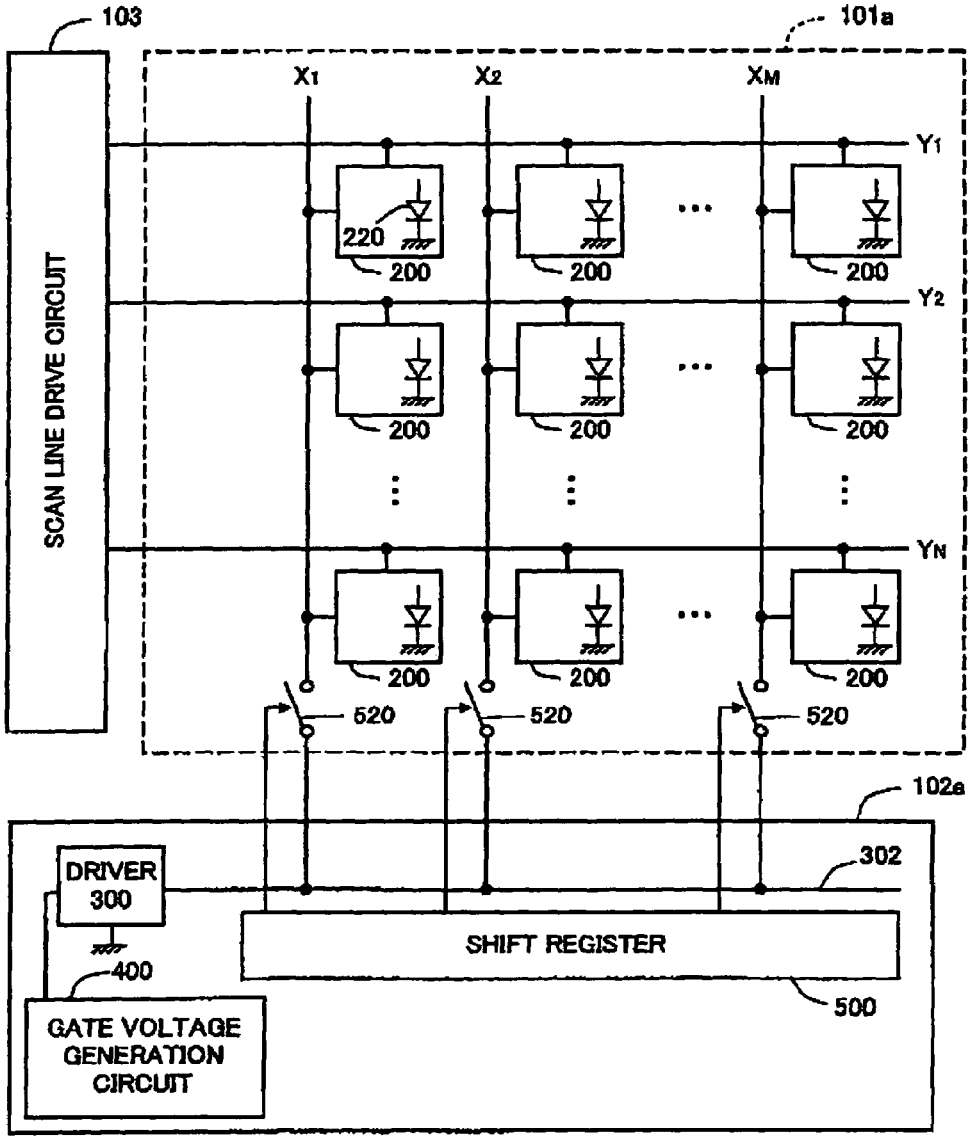
FIG. 8 is a block diagram showing the internal structure of the display panel section 101*a* and the data line drive circuit 102*a* in the second embodiment.

FIG. 8 shows the internal construction of a display panel section 101*a* and a data line drive circuit 102*a* in the second embodiment. In this display device, one single line driver 300 and a shift register 500 are provided in place of the plurality of single line drivers 300 in the structure in FIG. 2. A switching transistor 520 is provided on each data line of the display panel section 101*a*. One terminal of each switching transistor 520 is connected to the data lines $X_m$, and the other terminal is commonly connected to an output signal line 302 of the single line driver 300. A shift register 500 supplies an on/off control signal to the switching transistor 520 of each data line $X_m$ whereby the data lines $X_m$ are successively selected.

In this display device, pixel circuits 200 are successively updated in point succession. More specifically, only one pixel circuit 200 at the intersection of a gate line $Y_n$ selected by a scan line drive circuit 103 and a data line $X_m$ selected by the shift register 500 is updated with a single programming operation. For example, programming is successively carried out on M number of the pixel circuits 200 one at a time selected by the nth gate line $Y_n$, after which the M number of pixel circuits 200 on the next (n+1)th gate line are programmed one at a time. In contrast to this, the display device indicated in FIG. 8 and its operation differ from that of the first embodiment described above where a group of pixel circuits in one row are programmed at the same time (i.e., in line succession).

When programming is performed by the pixel circuits 200 in point succession as in the display device in FIG. 8, the same single line driver 300 and gate voltage generation circuit 400 are used as in the first embodiment described above in order to generate an output current $I_{out}$ and programming current $I_m$ having a desired current range.

D. Embodiments Applied to Electronic Devices

A display device using an organic electroluminescent device may be applied to a variety of electronic devices such as mobile personal computers, cellular phones and digital still cameras.

Figure 9:
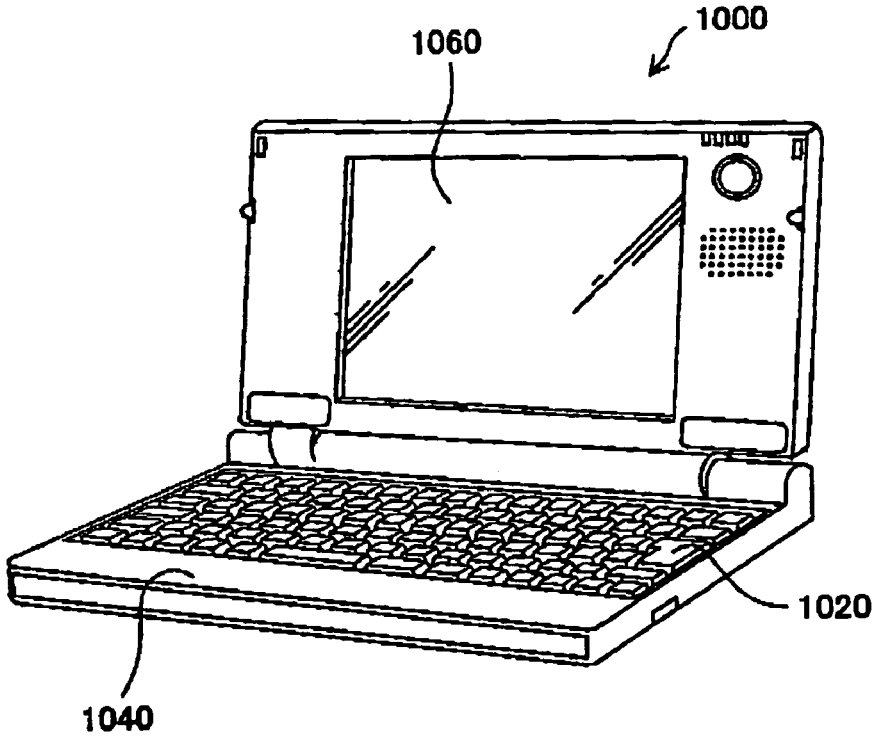
FIG. 9 is a perspective view showing the structure of a personal computer as one example of an electronic device to which the display device according to the present invention was applied.

FIG. 9 is a perspective view of a mobile personal computer. A personal computer 1000 is equipped with a main body 1040 having a keyboard 1020, and a display unit 1060 using organic electroluminescent devices.

Figure 10:
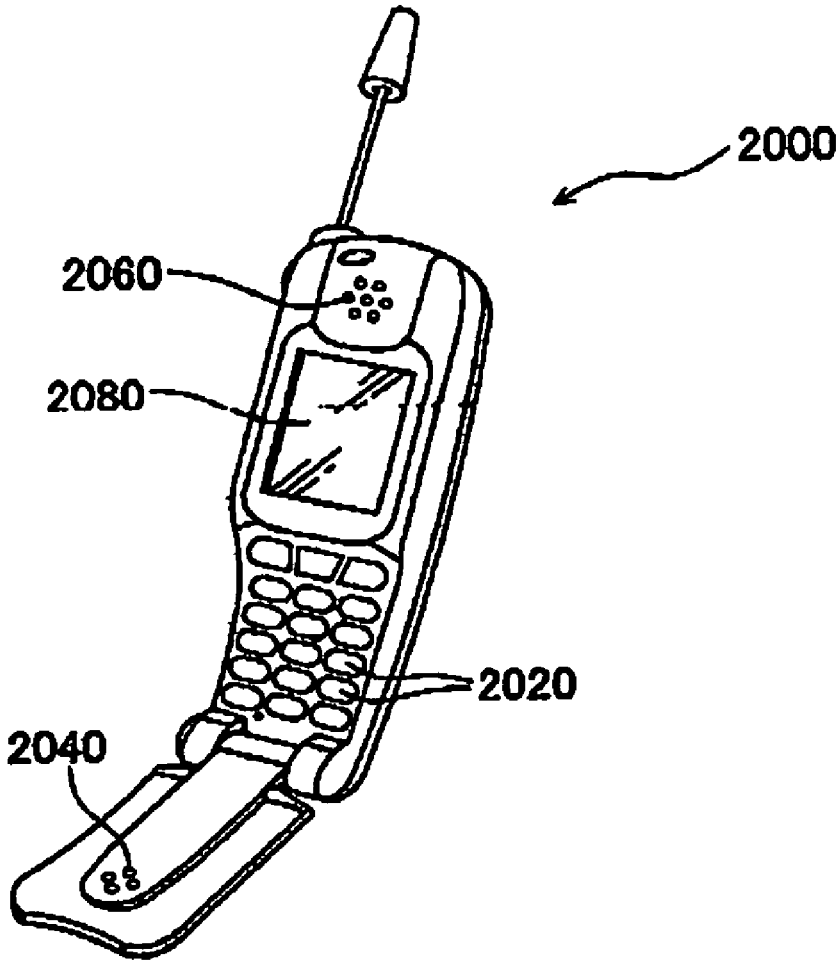
FIG. 10 is a perspective view showing the structure of a portable telephone as one example of an electronic device to which the display device of the present invention was applied.

FIG. 10 is a perspective view of a cellular phone. A cellular phone 2000 is equipped with a plurality of operation keys 2020, an ear piece 2040, a mouthpiece 2060, and a display panel 2080 using organic electroluminescent devices.

Figure 11:
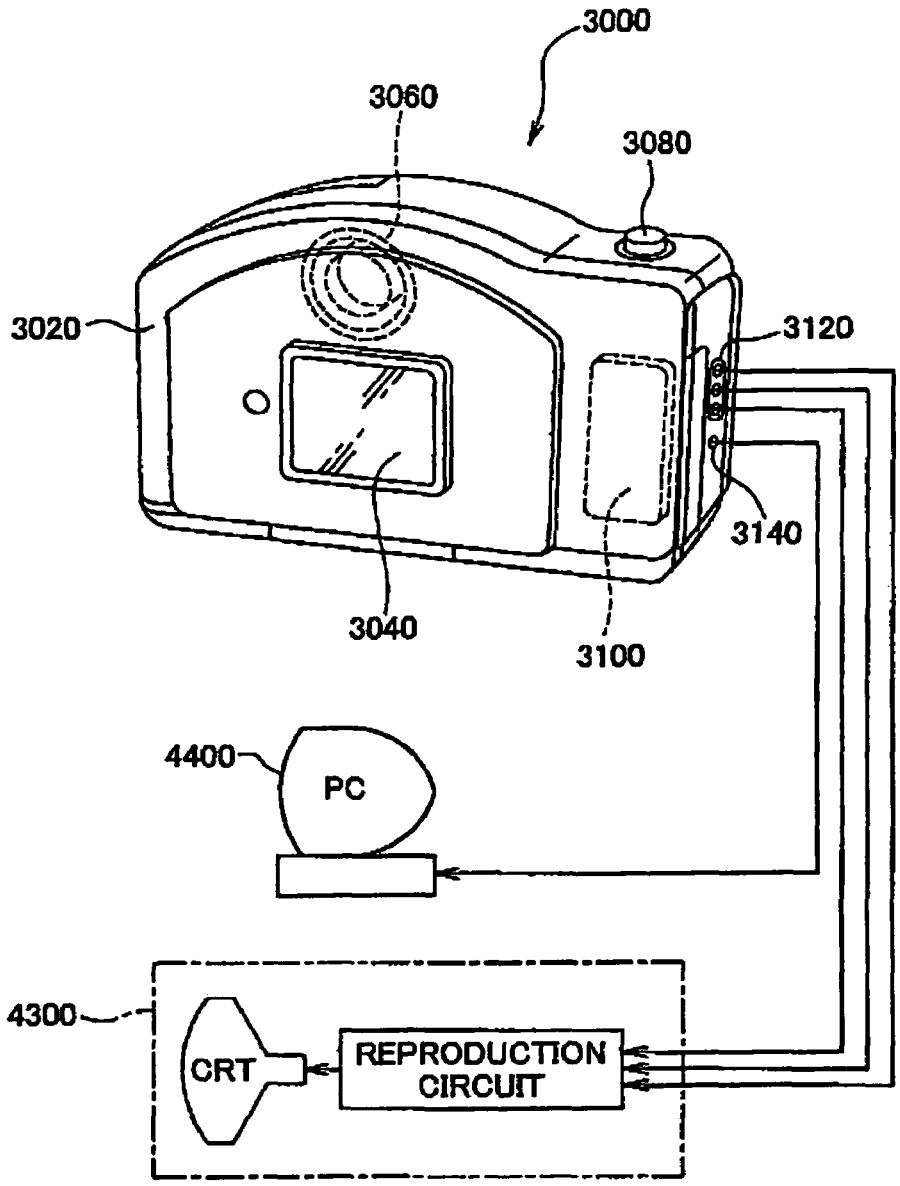
FIG. 11 is a perspective view showing the structure of the back side of a digital still camera as one example of an electronic device to which the display device of the present invention was applied.

FIG. 11 is a perspective view of a digital still camera 3000. Connections to external devices are indicated in a simplified fashion. While a conventional camera exposes film to the optical image of the object, the digital still camera 3000 generates an image signal through a photoelectric transfer by an image element such as a CCD (charge coupled device) of the optical image of the object. A display panel 3040 using organic electroluminescent devices is provided at the back of a case 3020 of the digital still camera 3000, and display is made based on image signals from the CCD. The display panel 3040 thus functions as a viewfinder to display the object. Also, a photo receiving unit 3060 including an optical lens and a CCD is provided on the observation side of the case 3020 (the back side in the figure).

When the photographer verifies the object displayed in the display panel 3040 and presses a shutter button 3080, the image signal of the CCD at that time is forwarded and stored in memory in a circuit board 3100. This digital still camera 3000 is provided with a video signal output terminal 3120 and a data communication I/O terminal 3140 at the side of the case 3020. As indicated in the figure, a television monitor 4300 may be connected to this video signal output terminal 3120 and a personal computer 4400 may be connected to the I/O terminal 3140 for data transmission according to need. Further, a prescribed operation may be used to output image signals stored in memory in the circuit board 3100 to the television monitor 4300 or the personal computer 4400.

Examples of electronic devices other than the personal computer in FIG. 9, the portable telephone in FIG. 10, and the digital still camera 3000 in FIG. 11 includes television monitor, a view finder or monitoring direct view type video tape recorder, a car navigation device, a pager, an electronic notebook, a calculator, a word processor, a work station, a video telephone, a POS terminal, and devices with a touch panel. The display device described above using organic electroluminescent devices may be applied to the display section of such electronic devices.

E. Modified Embodiments

Modification E1:

In the embodiment shown in FIG. 5, the resistance transistors 52, 41-48 are connected to the drive transistors 32, 21-28, but it is possible to replace the resistance transistors 52, 41-48 with other resistance elements or resistance adding means as well. Also, such resistance elements need not be necessarily be connected to all the drive transistors 31, 21-28, but may be provided according to need.

Modification E2:

Part of the circuit structure in FIG. 5 may be omitted. For example, the offset current generation circuit 320 may be omitted. If, however, the offset current generation circuit 320 is to be provided, the degree of freedom in setting the range of the programming current values increases, giving the advantage that setting a favorable range of programming current values is easy to do.

Modification E3:

In the embodiments described above, a part or all of the transistors may be replaced with bipolar transistors, thin film diodes or other types of switching elements. The gate electrodes of FETs and the base electrodes of bipolar transistors correspond to the "control electrodes" in the present invention.

Modification E4:

In the embodiments described above, the display panel section 101 has one pixel circuit matrix set, but it may have a plurality of sets of pixel circuit matrices as well. For example, when constructing a large panel, the display panel section 101 may be separated into a plurality of regions, and one pixel circuit matrix set may be provided for each region. Also, three pixel circuit matrix sets corresponding to the three RGB colors may be provided in one display panel section 101. When there is a plurality of pixel circuit matrices, the embodiments described above may be applied for each matrix.

Modification E5:

The pixel circuit used in the embodiments described above is separated into a programming period $T_{pr}$ and a light emission period $T_{el}$, but it is also possible to use a pixel circuit where the programming period $T_{pr}$ is present within a portion of the light emission period $T_{el}$. For such a pixel circuit, the programming is carried out and the light emission level is set in the initial stage of the light emission period $T_{el}$, after which the light emission continues with the set level. The data line drive circuits described above may be applied to a device using such a pixel circuit as well.

Modification E6:

In the embodiments described above, example display devices using organic electroluminescent devices are described, but the invention may be applied to display devices and electronic devices using electroluminescent devices other than organic electroluminescent devices as well. For example, it is possible to apply electroluminescent devices where the light emission level can be adjusted in response to the drive current (such as LEDs and FEDs (field emission displays)) as well as other types of electroluminescent devices.

Modification E7:

The present invention is not limited to circuits and devices which include pixel circuits and which are driven using an active driving method and, and the present invention is also applicable to circuits and devices which do not include pixel circuits and which are driven with a passive driving method.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A current generation circuit comprising:

constant current generation means;

a signal input line;

an output terminal;

a current output circuit for outputting to the output terminal an output current generated based on a reference current supplied from the constant current generation means and on a signal supplied to the signal input line, the current output circuit including a plurality of first transistors having different gain coefficients; and a first resistance adding circuit, disposed between the output terminal and the plurality of first transistors, with respect to at least one of the plurality of first transistors.

2. The current generation circuit according to claim 1, wherein the current output circuit generates the output current by synthesizing current flowing in one or more transistors selected from the plurality of first transistors by the signal to the signal input line.

3. The current generation circuit according to claim 1, wherein the constant current generation circuit includes a second transistor connected to a gate electrode of the first transistor.

4. The current generation circuit according to claim 3, wherein the second transistor has a function of converting the reference current to a gate voltage at the plurality of first transistors.

5. The current generation circuit according to claim 3, wherein the first resistance adding circuit is a third transistor.

6. The current generation circuit according to claim 5, wherein the constant current generation circuit includes a fourth transistor connected to a gate electrode of the third transistor.

7. The current generation circuit according to claim 3, wherein the current output circuit includes an offset current path for regulating a minimum value of the output current, and the offset current path has a fifth transistor whose gate electrode is connected to the second transistor.

8. The current generation circuit according to claim 7, further comprising a second resistance adding circuit disposed between the output terminal and the fifth transistor.

9. The current generation circuit according to claim 8, wherein the second resistance adding circuit is a sixth transistor.

10. The current generation circuit according to claim 7, wherein the output current is adjusted by variation of a gain coefficient of the fifth transistor.

11. A semiconductor integrated circuit device, comprising the current generation circuit according to claim 1.

12. A current generation circuit comprising:

a constant current generation circuit;

a signal input line;

an output terminal; and a current output circuit for outputting to the output terminal an output current generated based on a reference current supplied from the constant current generation circuit and on a signal supplied to the signal input line, wherein the current output circuit includes an offset current path for regulating a minimum value of the output current.

13. A semiconductor integrated circuit device, comprising the current generation circuit according to claim 12.

14. A current generation circuit comprising:

a constant current generation circuit;

a signal input line;

an output terminal; and a current output circuit for outputting to the output terminal an output current generated based on a reference current supplied from the constant current generation circuit and on a signal supplied to the signal input line, wherein the reference current is set to a value close to a center value of minimum and maximum values of the output current.

15. A semiconductor integrated circuit device, comprising the current generation circuit according to claim 14.

* * * * *